United States Patent [19]

Couture

[11] Patent Number: 4,888,934

[45] Date of Patent: Dec. 26, 1989

[54] BEAM STRUCTURE

[76] Inventor: Raymond Couture, 30 des Frênes Street, Bromont, Canada, J0E 1L0

[21] Appl. No.: 152,461

[22] Filed: Feb. 5, 1988

[51] Int. Cl.[4] ..... E04C 1/32

[52] U.S. Cl. ..... 52/807; 52/731

[58] Field of Search ..... 52/731, DIG. 6, 309.16, 52/806, 807, 808, 630, 690, 730

[56] References Cited

U.S. PATENT DOCUMENTS

| | | | |
|---|---|---|---|
| 2,730,211 | 1/1956 | Findlay . | |
| 2,829,403 | 4/1958 | Willatts | 52/731 |
| 3,081,579 | 3/1963 | Pelley | 52/309.16 |
| 3,111,206 | 11/1963 | Borup . | |
| 3,162,280 | 12/1964 | Hinze | 52/731 |
| 3,238,690 | 3/1966 | Wilkins | 52/731 |
| 3,257,764 | 6/1966 | Cripe | 52/731 |
| 3,893,276 | 7/1975 | Brown . | |
| 3,969,849 | 7/1976 | Franklin . | |

FOREIGN PATENT DOCUMENTS

| | | | |
|---|---|---|---|
| 667922 | 8/1963 | Canada . | |
| 969460 | 6/1975 | Canada | 52/309.16 |
| 1158911 | 6/1958 | France | 52/731 |

*Primary Examiner*—John E. Murtagh

[57] ABSTRACT

There is disclosed a beam structure for supporting a floor or roof. The beam is of V-shape cross-section, defining a lower apex and two upstanding side wings formed of wafer boards joined together at the apex by a coating of resin, in which is embedded, between the panels, a continuous tension-resisting cable. Compression-resisting strips are secured to the outside of the panels along their top edges. These strips are also made of wafer boards and serve to receive screws for securing the beam to the underside of the floor or roof.

7 Claims, 1 Drawing Sheet

BEAM STRUCTURE

FIELD OF THE INVENTION

The present invention relates to a beam structure and, more particularly, of the type for directly supporting a floor or roof.

BACKGROUND OF THE INVENTION

In the construction of housing, buildings and the like, wooden joists directly support the floor or roof and these in turn are supported by underlying transverse wooden beams or metal beams, depending on the span between the columns or wall. Wooden joists are expensive, have a tendency to warp and must be installed close apart to properly support the floor.

OBJECTS OF THE INVENTION

It is the general object of the invention to provide beams structures adapted to replace wooden joists for supporting a floor or roof, which is of inexpensive construction; which can be easily secured to the underside of a floor or roof; which can be manufactured in a continuous length to be cut to the required length; and which have an increased resistance to deflection as compared to wooden joists of the same thickness.

Another object of the invention is to provide a beam structure of V-shape cross-section, arranged to be fastened directly to the underside of a floor or roof.

SUMMARY OF THE INVENTION

The beam structure of the invention has a V-shape cross-section, defining a lower apex and two upstanding side wings, the side wings formed of substantially imperforate panels, having top and bottom longitudinal edges, the bottom longitudinal edges joined together to form the apex, a coating of resin adhering to and joining said panels at said apex, and preferably a continuous tension-resisting cable extending along and contiguous to said apex and embedded in said resin. narrow strips are secured to each panel adjacent their top edge, said strips resisting compression forces and provided means to receive screws or the like fasteners to directly fasten the beam underneath a floor or roof. Preferably, the cable is located between the panels and the strips are located exteriorly of said panels. Said panels and said strips are made of wood wafer board, preferably oriented strength board, and preferably have a minimum thickness of ¼ inch and 7/16 inch respectively. Preferably the included angle between the panels is about 60 degrees. The bottom edges of the panels form bevelled bottom edge faces disposed opposite each other and forming a butt joint, while the top edges of the panels and of the strips are also preferably bevelled and are co-planar for the two wings to be directly secured to a floor such as a floor made of tongue-and-groove boards extending transversely of the beam of the invention. The invention is also directed to the combination of the floor or roof with the beam structure.

BRIEF DESCRIPTION OF THE DRAWINGS

In the drawings, like reference characters indicazte like elements throughout.

DETAILED DESCRIPTION OF THE PREFERRED EMBODIMENT

Figure 1:
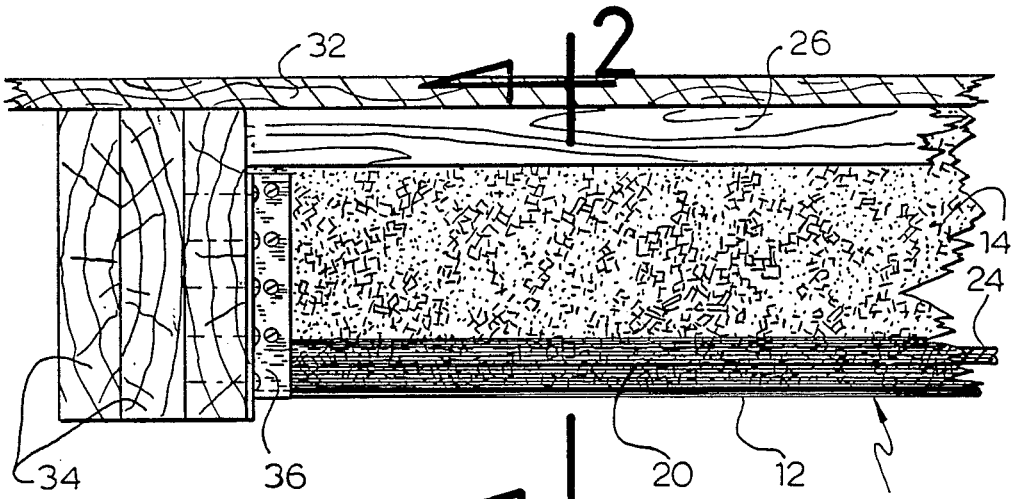
FIG. 1 is a partial side elevation of a beam structure of the invention supporting a floor.
Figure 2:
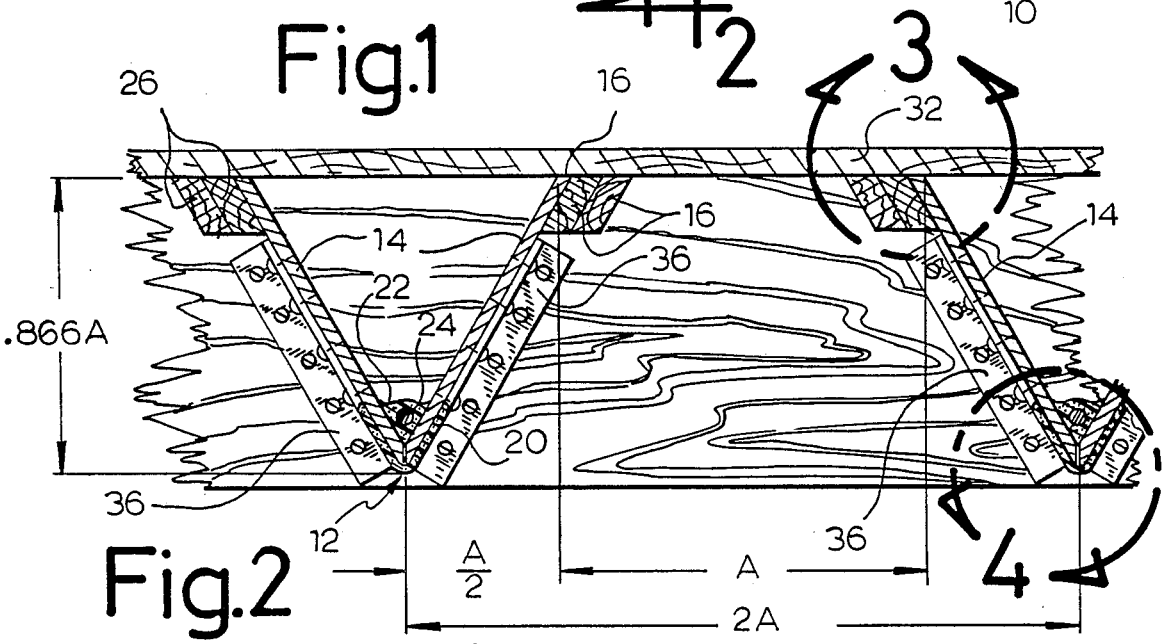
FIG. 2 is a cross-section of the beam and of the floor, taken along line 2—2 of FIG. 1.

The beam structure of the invention is generally shown at 10. It is of V-shape cross-section, defining a lower apex 12 and inclined side wings 14, each consisting of a substantially imperforate, elongate panel, made of wood wafer board, that is wooden wafers pressed into a board and adhered together by a synthetic resin. The wafers are preferably cross oriented in several layers to form a well-known board called "oriented strength board".

The panels 14 forming the side wings have longitudinal top edges 16 and longitudinal bottom edges. The included angle between the side wings 14 is approximately 60 degrees and the top edges 16 are suitably bevelled, so as to be substantially co-planar. The bottom edges are also bevelled to form bottom bevelled edge faces 18 which are opposite each other and form a butt joint at the apex 12. The two panels at the apex 12 are adhered and joined together by means of a coating of resin 20, which coats the bottom bevelled edge faces 18 and also the marginal areas on the outside and inside faces of the panels adjacent the bottom bevelled edge faces 18. The coating 20 forms a bridge 22 between the two side wings and prevents humidity from penetrating the areas of the side wings subjected to maximum tension. It is known in this respect that the tensional resistance of wood wafer boards decreases when exposed to humidity. A tension-resisting cable 24 is preferably embedded in bridge 22.

Figure 3:
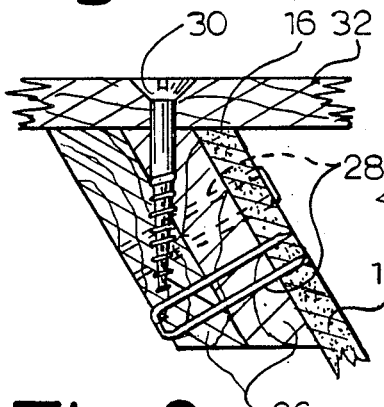
FIGS. 3 and 4 are partial sections, on an enlarged scale, of the area shown by circles 3 and 4, respectively, in FIG. 2.
Figure 4:
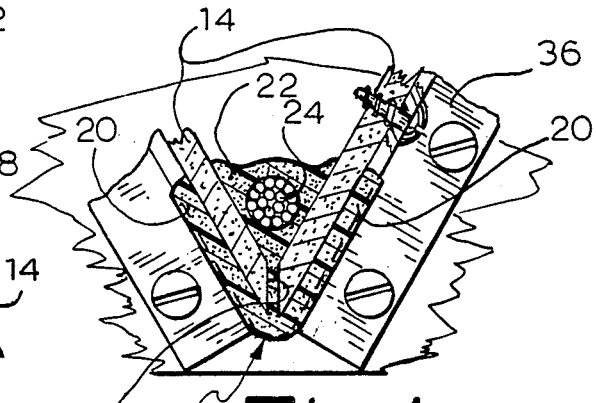

The resin itself is preferably a polyester. The cable 24 may be made of continuous glass-fibers or carbon fibers, or other types of synthetic resin fibers, such as nylon or "Kevlar" (aromatic polyamide). The cable 20, wich is embedded in the bridge portion 22 of the coating 20, imparts strong resistance to tension along the tension bottom cord of the beam 10. Since cable 20 is located between wings 14, it is well protected against damage. However, it could be located on the outside of apex 12. Wooden strips 26 are adhered to the outside of each side wing 14, adjacent top edges 16. Strips 26 are preferably made of oriented strength board and there are two superposed strips for each side wing 14. These strips are adhered to each other and to the panels 14 by means of a synthetic resin. They are further secured in place by U-shape metallic cramps 28 driven from opposite sides of the assembly, as shown in FIG. 3. The top edges of the strips 26 are bevelled and co-planar with the top edges 16 of the side wings.

The panels 14 generally have a thickness of at least one-quarter inch and each strip 26 a thickness of about 7/16 inch. The strips 26 resist compression forces along the top cord of the beam and also provide a mass of material for receiving screws 30 or the like fasteners which extend through the floor or roof 32 and directly secure the beam 20 to the underside of the floor or roof 32. The floor or roof 32 preferably consists of 4′×8′ plywood panels, longitudinally extending transversely of the beams 10, arranged in staggered relation and provided with tongue-and-groove joints. This is a well-known floor or roof construction. It is noted that there is no need for any cross-member joining the top edges of the side wings. The beams, when joined to the floor or roof 32, form a rigid structure of triangular shape, preferably in the form of an equilateral triangle. The floor or roof 32 helps in resisting compression forces longitudinally and transversely of beams 10. A monoshell assembly is obtained.

For floors of houses and similar residential units, the beams 10 would have about a height of 10½ inch, and the beams are installed 24" center to center directly under the flooring.

Because the beams are V-shape, they are particularly suited for mass-production in a continuous length, which is then cut down to a specific length for a specific application. The strips 26 are installed with the finger type butt joints of the inner strips staggered relative to the similar joints of the outer strips. The panels 14 can be eight-foot lengths jointed at 38 by finger type butt joints.

The ends of the beams 10 may be directly secured to the sides of wooden beams joists 34 or other types of main beams of angle sheet metal strap 36 forming a V-shape support which would extend around the apex 12 of the beam 10. With this arrangement, the head room lost due to the overall floor or roof thickness is minimized.

The beams 10 do not transmit sound, and wings 14 can be perforated for the passage of plumbing pipes and electrical wires; beams 10 can be nested one within the other to save room during handling and shipping.

I claim:

1. A beam structure for supporting a floor or roof, of V-shape cross-section, defining an apex and two side wings, said side wings formed of substantially imperforate flat panels consisting of wood wafer boards and having top and bottom longitudinal edges and joined together at their bottom edges to form said apex, said bottom edges forming bottom bevelled edge faces located opposite each other and constituting a butt joint, a coating of synthetic resin adhering to and joining said panels at said apex, said coating resin extending between and coating said bottom bevelled edge faces of said panels and bridging and coating marginal areas of the inside and outside faces of said panels at said apex, and narrow strips secured to any of said faces of each panel adjacent its top longitudinal edge.

2. A beam structure as defined in claim 1, further including a continuous tension-resisting cable extending along and contiguous to said apex between said wings and embedded in said resin.

3. A beam structure as defined in claim 11, wherein said strips are located exteriorly of said panels and are adhered to the latter.

4. A beam structure as defined in claim 3, wherein there are at least two superposed strips adhering to each other and to each panel.

5. A beam structure as defined in claim 4, wherein the wood wafer boards forming said panels are at least one-quarter inch thickness and said strips are also made of wood wafer board of at least 7/16 of an inch thickness.

6. A beam structure as defined in claim 5, wherein the included panels formed by said side angle is about 60 degrees.

7. A beam structure as defined in claim 4, further including a continuous tension-resisting cable extending along and contiguous to said apex and disposed between said two wings and embedded in said resin.

* * * * *